United States Patent [19]

Rohs et al.

[11] Patent Number: 4,740,142

[45] Date of Patent: Apr. 26, 1988

[54] VARIABLE CAPACITY GEAR PUMP WITH PRESSURE BALANCE FOR TRANSVERSE FORCES

[76] Inventors: Hans-Gunther Rohs, Neuffenstr. 9, 7324 Rechberghausen; Ulrich Rohs, Roonstr. 11, 5160 Duren; Jochen Reimann, Eburonenstr. 26; Dieter Voigt, Parkstr. 70, both of 5100 Aachen, all of Fed. Rep. of Germany

[21] Appl. No.: 895,349

[22] Filed: Aug. 11, 1986

[30] Foreign Application Priority Data

Aug. 9, 1985 [DE] Fed. Rep. of Germany ..... 3528651

[51] Int. Cl.[4] ..... F04C 2/18; F04C 15/04

[52] U.S. Cl. ..... 418/21; 418/26; 418/27; 418/74

[58] Field of Search ..... 418/21, 24–27, 418/71, 73, 74

[56] References Cited

U.S. PATENT DOCUMENTS

| | | | |
|---|---|---|---|
| 2,079,375 | 5/1937 | McCollum | 418/21 |
| 2,212,994 | 8/1940 | Vrolix | 418/74 |
| 2,293,126 | 8/1942 | Fersing | 418/21 |
| 2,526,830 | 10/1950 | Purcell | 418/21 |
| 3,029,739 | 4/1962 | Nagely | 418/73 |

FOREIGN PATENT DOCUMENTS

| | | | |
|---|---|---|---|
| 375986 | 5/1923 | Fed. Rep. of Germany . | |
| 1337418 | 8/1963 | France | 418/21 |

*Primary Examiner*—John J. Vrablik

*Attorney, Agent, or Firm*—Collard, Roe & Galgano

[57] ABSTRACT

A gear pump in which one rotating, toothed pump gear is supported axially displaceable in the pump casing and engaging an axially displaceable sliding part at least on the one face wall of the pump gear. The sliding part is adapted to overlap the operating space or zone of engagement of the displaceable pump gear against the other, axially stationary pump gear, with hydraulic relief provided by the pump casing and/or the sliding part by pocket-like recesses on the side diametrically opposing the pressure side of the pump across the displaceable pump gear, the recesses hydraulically communicating with the pressure side of the pump.

6 Claims, 11 Drawing Sheets

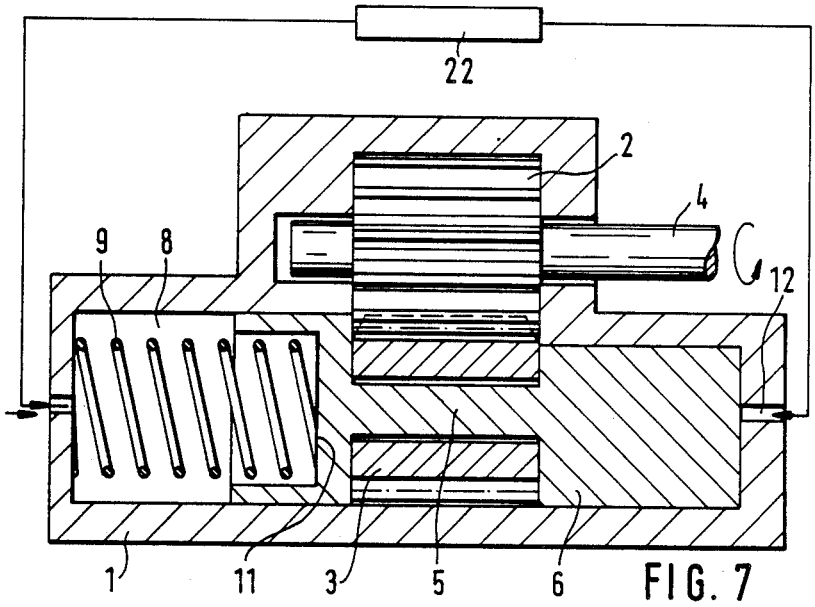
FIG. 7
FIG. 8
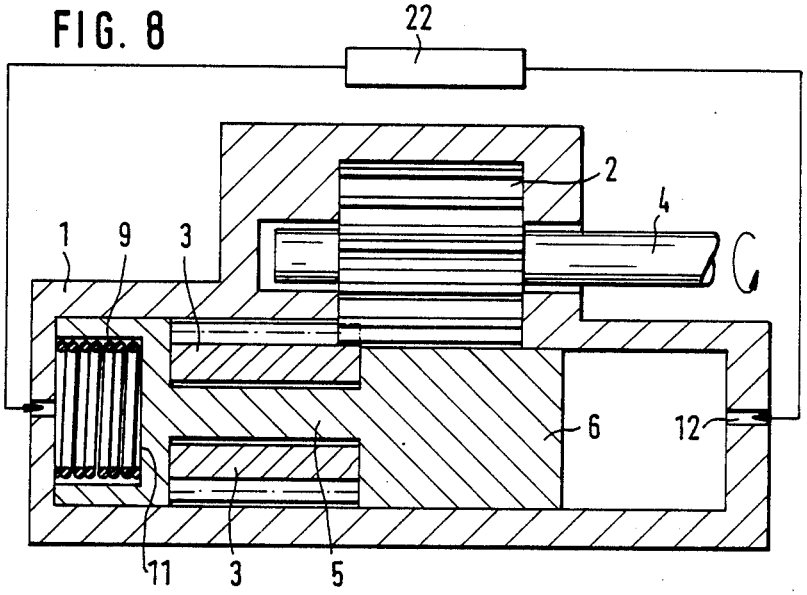

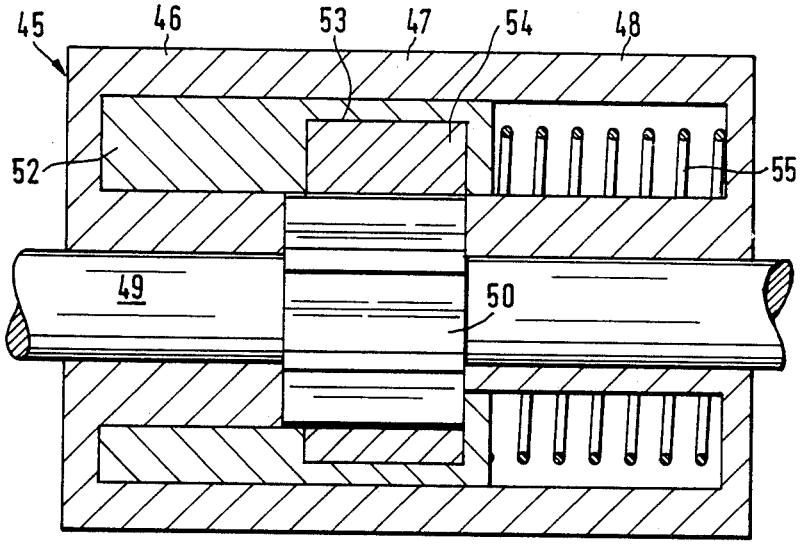
FIG. 17
FIG. 18
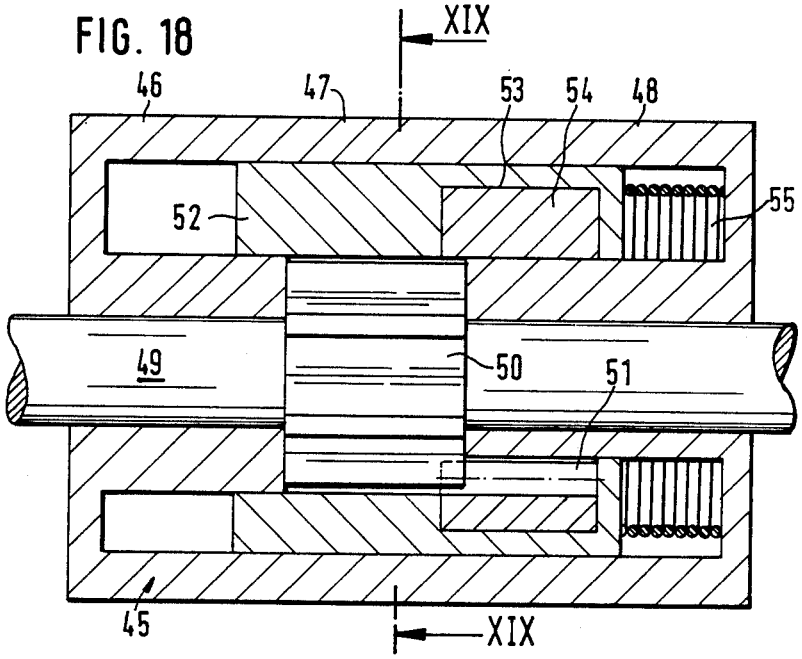

VARIABLE CAPACITY GEAR PUMP WITH PRESSURE BALANCE FOR TRANSVERSE FORCES

The present invention relates to a gear pump in which one rotating pump gear is supported by, and axially displaceable in the pump casing, engaging an axially displaceable sliding part on at least one of the end walls of the pump gear. The sliding part is adapted to overlap the operating space or zone of engagement occupied by this pump gear opposing the other, axially stationary pump gear, whereby on that portion of the surface of the sliding part which faces the stationary pump gear the sliding part is contoured to match the path of the teeth of the stationary pump gear.

Such a gear pump is known, for example from German Patent DE-PS No. 375,986, which has not been in use in the last 60 years. Gear pumps used, for example to supply a motor vehicle or machine tool with lubricating oil, are suitably controlled by regulating their delivery or outlet pressure. Heretofore, the delivery of geared pumps has been controlled by regulating their r.p.m., which is a relatively costly method. For example, in motor vehicles, the gear pump for supplying lubricating oil is invariably preset to the maximum required amount of delivery and operated at a constant rate. Since substantially less delivery is required at high engine speeds than at low engine speeds, the feed lines are provided with pressure relief valves for reducing the excessive outlet pressure of the pump. However, this means that the gear pump, because of its inflexible design for maximum delivery, consumes energy unnecessarily during a substantial part of its operating time and is therefore uneconomical.

The above-mentioned earlier design of a gear pump requires much simpler control means. Tests have shown that the known gear pump was not sufficiently efficient because of its relatively great axial length and the high transverse forces acting on it.

It is, therefore, the object of the present invention to enhance the design of prior art gear pumps in a way such that the pump will perform in the best possible manner by controlling or regulating the volume of the delivery of the gear pump.

This object is accomplished in accordance with the present invention by providing the pump casing with a pocket-like recess disposed between the pump gears on the side diametrically opposing the pressure side of the pump across the axially displaceable pump gear, the recess hydraulically communicating with the pressure side of the pump, and by arranging the recess in a location of the pump casing which is disposed within the engagement zone of the pump gears even when the movable pump gear is axially displaced. Such hydraulic relief cancels the effect of the transverse forces acting on the delivery side of the pump and assures its capacity to rotate.

According to another feature of the present invention, the relief from transverse forces is alternatively or additionally accomplished by providing the sliding part with pocket-like recesses disposed axially on both sides of the pump gear that is actuated by the sliding part, diametrically opposite the pressure side of the pump, the pressure side being disposed between the pump gears, and the recesses hydraulically communicating with the pressure side of the pump between the pump gears.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 7 shows a controlled gear pump according to the present invention in the state of maximum delivery;

FIG. 8 shows the pump according to FIG. 7 in the state of minimum delivery;

FIG. 17 shows a gear pump according to the present invention in the form of an Eaton pump in the state of maximum delivery, the pump having an axially displaceable external gear;

FIG. 18 shows the pump according to FIG. 17 in the state of minimum delivery;

Figure 1:
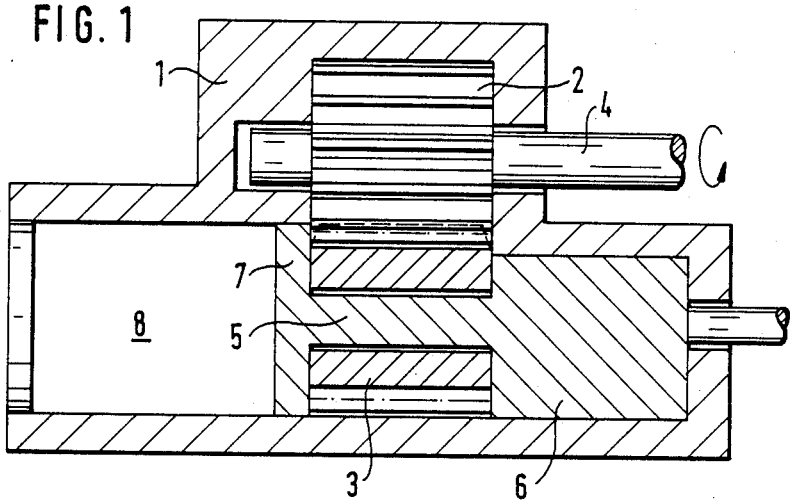
FIG. 1 shows a gear pump according to the present invention in the state of maximum delivery.
Figure 2:
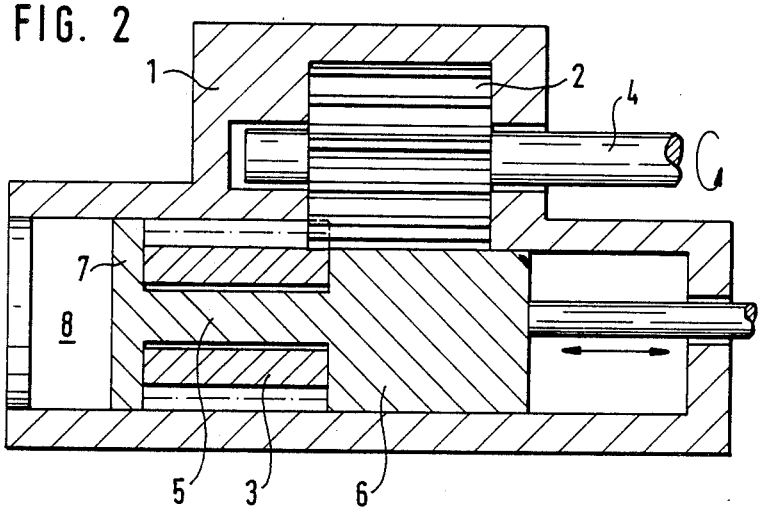
FIG. 2 shows the pump according to FIG. 1 in the state of minimum delivery.

Now turning to the drawings, the gear pump shown in FIGS. 1 and 2 substantially consists of mating spur gears 2 and 3 which are arranged in a pump casing 1. Pump gear 2 is mounted on a driven shaft 4. Pump gear 3 is mounted loosely rotatable on an axle journal 5 of a sliding part 6, which is arranged in pump casing 1 and axially displaceable. On the end of its axle journal 5, sliding part 6 supports a flanged disk 7, which limits the pump space at the face side of the pump gear that is averted from sliding part 6, and serves as a guiding means.

When sliding part 6 is axially displaced to the left, as shown in FIG. 2, the active volume of the pump is reduced to the part in which the pump gears 2 and 3 still mate with each other. In this way, a gear pump with volume-controlled delivery results.

Figure 3:
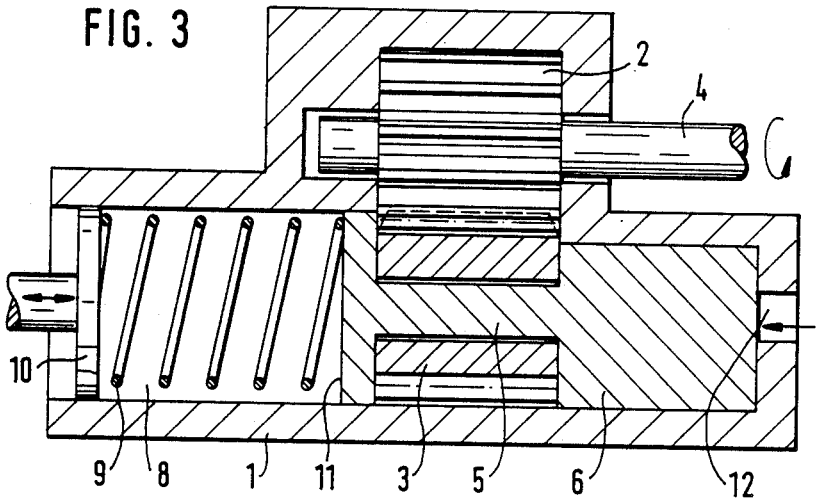
FIG. 3 shows a modified gear pump according to the present invention in the state of maximum delivery.
Figure 4:
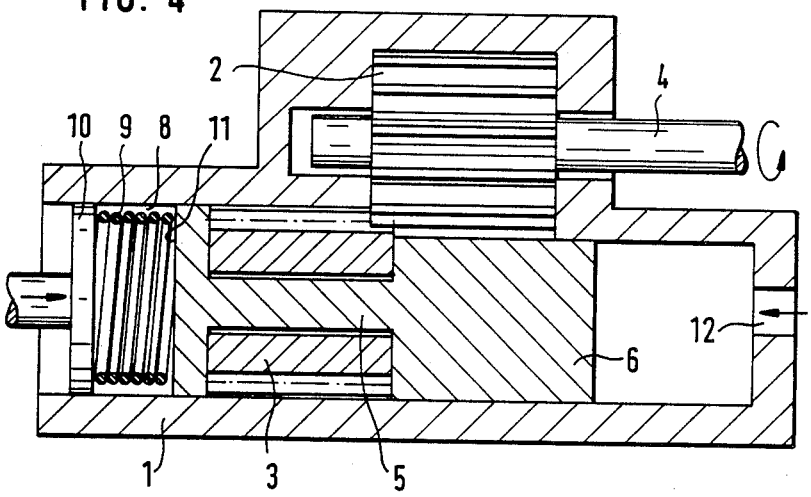
FIG. 4 shows the pump according to FIG. 3 in the state of minimum delivery.

FIGS. 3 and 4 show an embodiment of the gear pump in the form of a controlled pump. In this pump, a pressure spring which, preferably, can be pre-stressed, is arranged in displacement space 8 of pump casing 1, serving as the control spring 9, which is supported on a preferably axially adjustable bottom plate 10, on the one side, and on the face side 11 of the sliding part 6 on the other side. In order to control the pump as a function of the outlet pressure, the other side 12 of the pump casing 1 is connected with the pressure side 13 (FIG. 9) of the gear pump. This connection is disposed in a location where the two pump gears 2 and 3 still overlap each other when in the position of greatest axial displacement against each other, that is, where the gears still are active as a pump.

In order to function, the pump according to the invention has a part 15 of the surface of sliding part 6 facing stationary supported pump gear 2 having a contour matching the path of the tooth tips 16 of the axially stationary pump gear. In the case of FIGS. 1 to 10, that is, with spur gears, the cross section of sliding part 6 has a recess with partial limitation of the circular arc. This design assures that no substantial amounts of oil will accumulate within the zone of sliding part 6 and reduce the pumping performance of the pump.

Since the pressure prevailing or building up on pressure side 13 may become very high, correspondingly high transverse forces act on sliding part 6 which may have a bearing on the easy axial mobility of the part. Relief is provided from these high transverse forces in order to avoid such influence by the designs shown in FIGS. 5 and 6. These two designs permit such hydraulic relief which may be utilized alternatively or jointly and which are shown in the same embodiment. This hydraulic relief is provided for all embodiments of the gear pumps herein described even where not shown in greater detail. As clearly seen in FIGS. 5, 6 and 9, sliding part 6 has pocket-like recesses disposed on both sides of pump gear 3, which it supports, diametrically opposite the pressure side 13 of the pump. These recesses are hydraulically connected with the pressure side 13 by way of suitable bores 18. By this measure, the same pressure is generated both on the pressure side 13 and in the pocket-like recesses 17, and the sliding part 6 is relieved of transverse forces.

Figure 5:
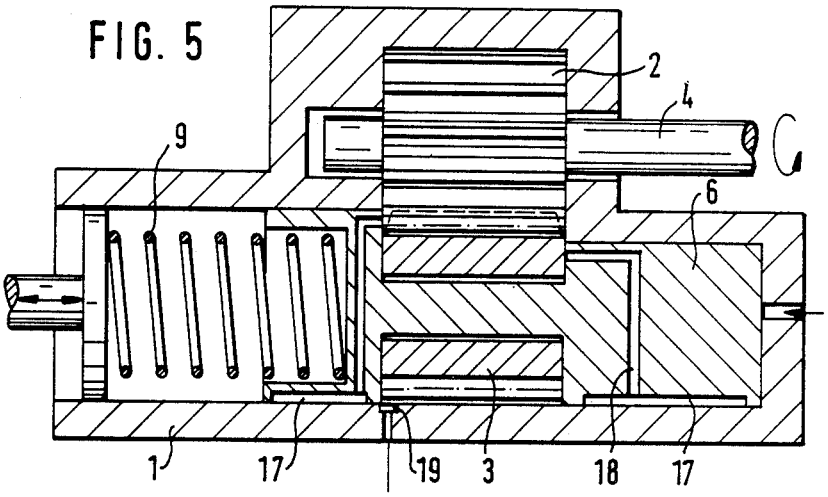
FIG. 5 shows a gear pump according to the present invention with pressure compensation in the state of maximum delivery.
Figure 6:
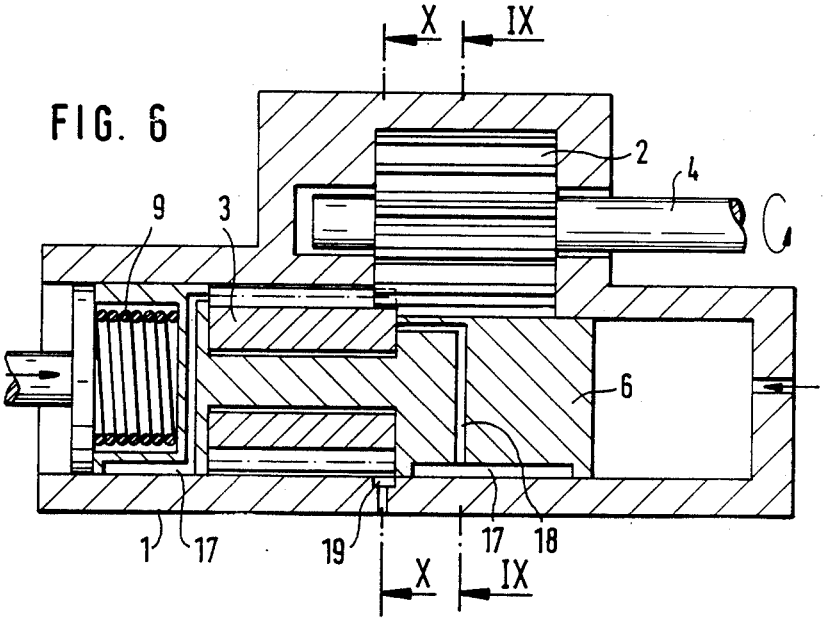
FIG. 6 shows the gear pump according to FIG. 5 in the state of minimum delivery.
Figure 9:
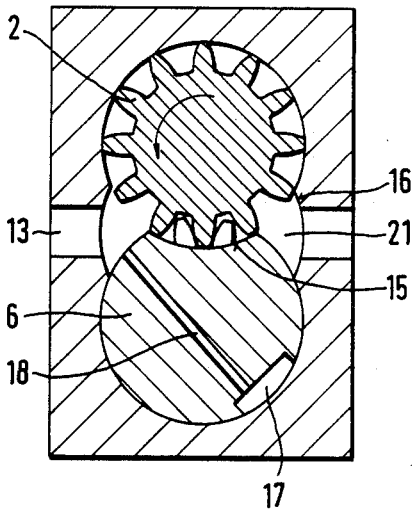
FIG. 9 is a cross-sectional view of the gear pump of FIG. 6 taken along line IX—IX of FIG. 6.
Figure 10:
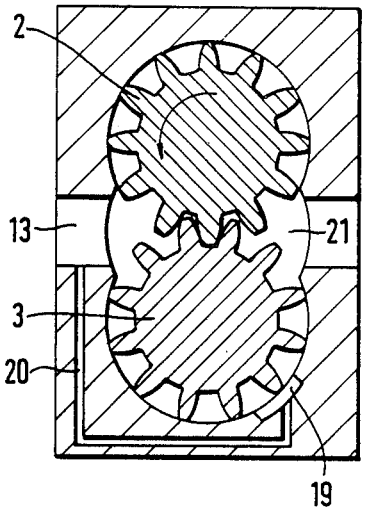
FIG. 10 is a cross-sectional view of the gear pump of FIG. 6 taken along line X—X of FIG. 6.

FIGS. 5, 6 and 9 show another possibility of hydraulic relief, which is accomplished by providing pump casing 1 itself with a pocket-like recess 19, instead of providing the recess in sliding part 6. Recess 19 is hydraulically connected with pressure side 13 of the pump by way of suitable bores 20.

The lateral limitations of recesses 17 and 19 are provided in a way such that the recesses do not communicate with suction side 21 of the pump.

FIGS. 7 and 8 show another embodiment of a gear pump shown in its state of maximum and minimum delivery, respectively. In this embodiment, which is similar to the one shown in FIGS. 3 and 4, the displacement space 8 and the side 12 of pump casing 1 each are connected with a controller 22, which determines the axial position of the sliding part 6 as a function of a given parameter.

Within the framework of the invention, it is possible, too, to provide a gear pump in which the one gear of the pump is a hollow gear with an interior toothing. Embodiments of such a pump are shown in FIGS. 11 to 22.

Figure 11:
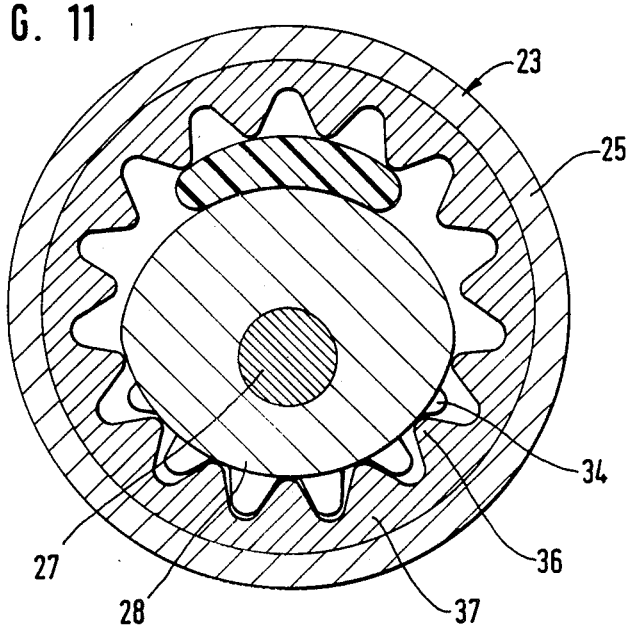
FIG. 11 is a cross-sectional view of the gear pump of FIG. 13 taken along line XI—XI in FIG. 13.
Figure 12:
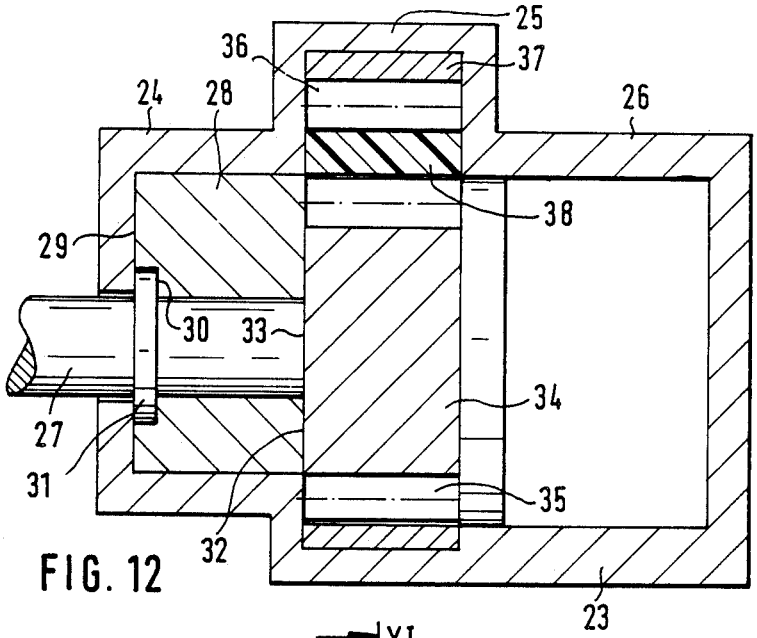
FIG. 12 shows a gear pump according to the present invention with hollow-gear toothing in the state of maximum delivery.
Figure 13:
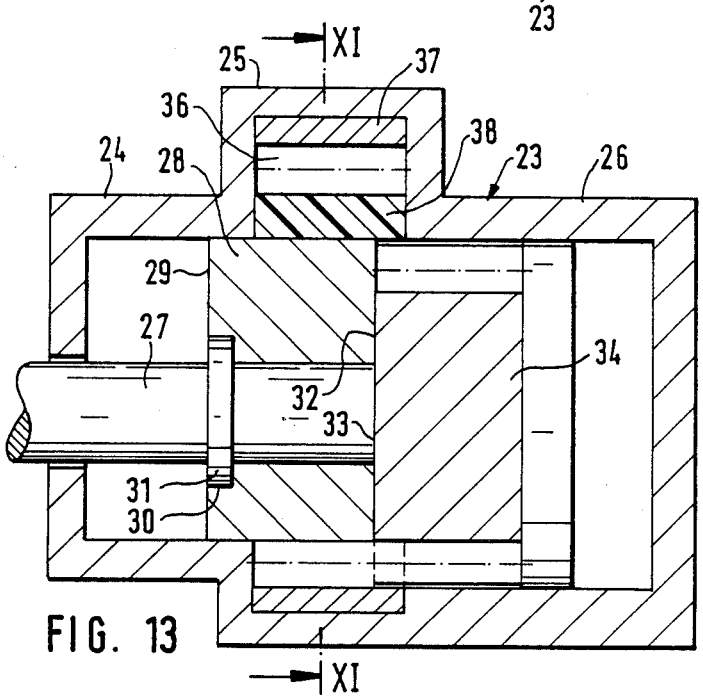
FIG. 13 shows the pump according to FIG. 12 in the state of minimum delivery.

FIGS. 11 to 13 show a gear pump with a hollow gear with interior toothing serving as the pumping gear. For this purpose, the pump casing 23 is divided into the three segments 24, 25, 26, which are arranged axially in tandem and eccentrically relative to each other. Drive shaft 27 is supported in segment 24. A sliding part 28 is supported on shaft 27 and rotatable relative to said shaft, but non-rotatble relative to pump casing 23. The face side 29 of part 28, which side is disposed on the driving side, is provided with a cylindrical recess 30 engaged by a ring or collar 31, which is axially rigidly connected with drive shaft 27. The other face side 32 of sliding part 28 rests against the one face side 33 of a pump gear 34, which is centrally seated on drive shaft 27 and is provided with a spur gear 35. Pump gear 34 eccentrically engages the interior toothing 36 of a rotating hollow gear 37 provided with an interior toothing, gear 37 being supported in casing segment 25. This segment 25 of the casing is eccentrically expanded or widened for accommodating hollow gear 37 forming the second gear of the pump.

Casing segment 26 joining casing segment 25 is designed in such a way that it is slightly displaced eccentrically relative to the casing segment 24 as well. The inside diameter of segment 26 conforms to the diameter of the tips of the teeth of pump gear 34.

A stationary breaker 38 is disposed within the zone of the casing segment 25 between hollow gear 37 and the part of the outside diameter of pump gear 34 that is not in engagement with gear 37. Breaker 38 has an outer jacket surface equal to the inside radius of hollow gear 37, and an interior jacket surface equal to the outside radius of pump gear 34 and sliding part 28 that is associated with gear 34.

FIG. 13 shows that the delivery of the pump is changed from the adjustment of maximum delivery shown in FIG. 12 to a position of minimum delivery by axially displacing pump gear 34 and the sliding part 28. The position of minimum delivery conforms to the axial length of tooth engagement.

Figure 14:
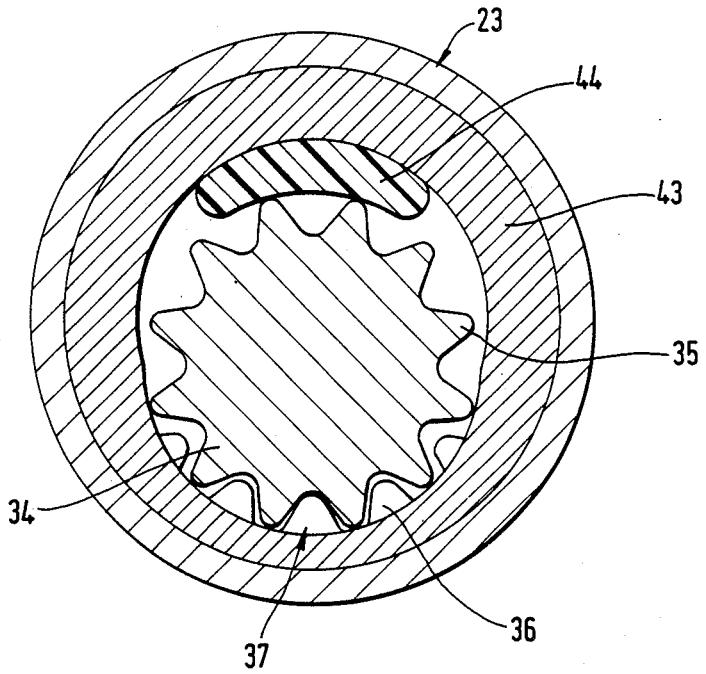
FIG. 14 is a cross-sectional view of the gear pump of FIG. 16 taken along line XIV—XIV of FIG. 16.
Figure 15:
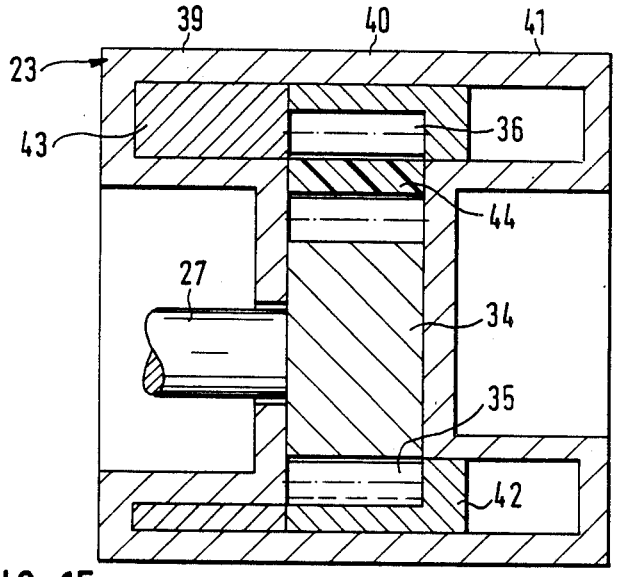
FIG. 15 shows a gear pump according to the present invention with hollow-gear toothing in the state of maximum delivery.
Figure 16:
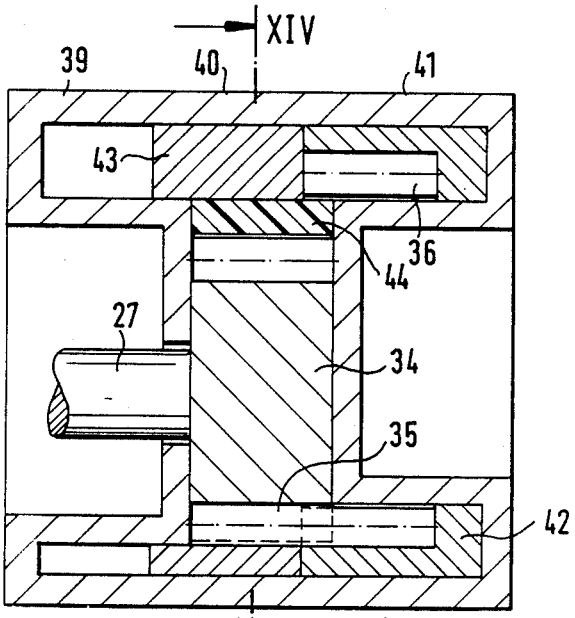
FIG. 16 shows the pump according to FIG. 15 in the state of minimum delivery.

FIGS. 14 to 16 show an embodiment of a pump with a hollow gear similar to FIGS. 11 to 13, however, with the difference that in the embodiment of FIGS. 14 to 16, hollow gear 37 is axially displaced relative to pump casing 23 and the drive pump gear 34 is stationarily rotating in the pump casing 23 without axial displaceability. In this embodiment, pump casing 23 consists of two ring-shaped outer segments 39 and 41, and a center cylindrical segment 40. Pump gear 34 is eccentrically supported in segment 40 and has an external toothing 35 mating with interior toothing 36 or hollow gear 37. Hollow gear 37, on the one side, extends axially with a non-toothed edge part 42 up into the adjacent ring-shaped casing segment 41 and serves as a guide. A sliding part 43 is arranged in the casing segment 39, said sliding part covering the face of hollow gear 37. In addition, a breaker 44 is disposed within the zone between the part of pump gear 34 that is not in engagement with hollow gear 37, and the interior circumference of hollow gear 37 or sliding part 43. When sliding part 43 in FIG. 15 is displaced to the right, hollow gear 37 is also axially displaced to the right until only a minimum amount of its axial length engages the axially stationary pump gear 34, which is the position for minimum delivery of the pump.

Figure 19:
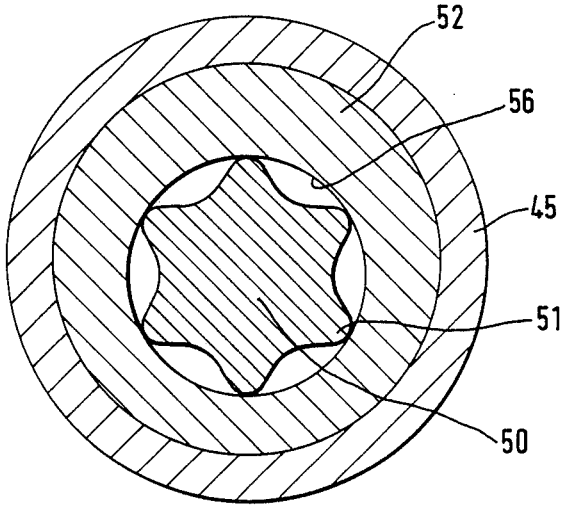
FIG. 19 is a cross-sectional view of the gear pump of FIG. 18 taken along line XIX—XIX of FIG. 18.

FIGS. 17 to 19 show an embodiment of a gear pump with a pump gear designed as a hollow gear in the form of a so-called Eaton pump with an axially displaceable hollow gear. This embodiment is similar to the one shown in FIGS. 14 to 16, however, with some differences as compared to the latter. Pump casing 45 consists of a center cylindrical segment 47 and two ring-shaped segments 46 and 48 joining the center segment on each side thereof. A pump gear 50 having the typical toothing 51 of Eaton pumps as shown in FIG. 19 is axially immovably seated on drive shaft 49, which is supported in pump casing 45. A sliding part 52 is arranged in the segment 46 extending up into segment 48 and having an eccentric cylindrical recess 53. The axially displaceable second gear of the pump, hollow gear 54 provided with an interior toothing, is rotatably supported and form-fitted in recess 53. A coil spring 55 serving as a reset or control spring is disposed in casing segment 48 and engages the other face side of the sliding part 52. In this embodiment, no additional breaker is required due to the special toothing of the Eaton pump. Ring-shaped sliding part 52 is centrally located in casing segment 46 and has an eccentric bore 56. Drive shaft 49 and thus pump gear 50 are also arranged centrically relative to said bore 56, said pump gear eccentrically mating with hollow gear 54. By axially displacing sliding part 52, the delivery of the pump is changed depending upon the active axial length of engagement of the two pump gears 50 and 54.

Figure 20:
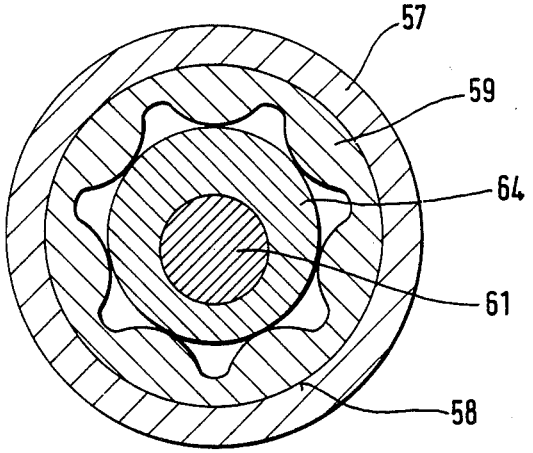
FIG. 20 is a cross-sectional view of the gear pump of FIG. 22 taken along line XX—XX of FIG. 22.
Figure 21:
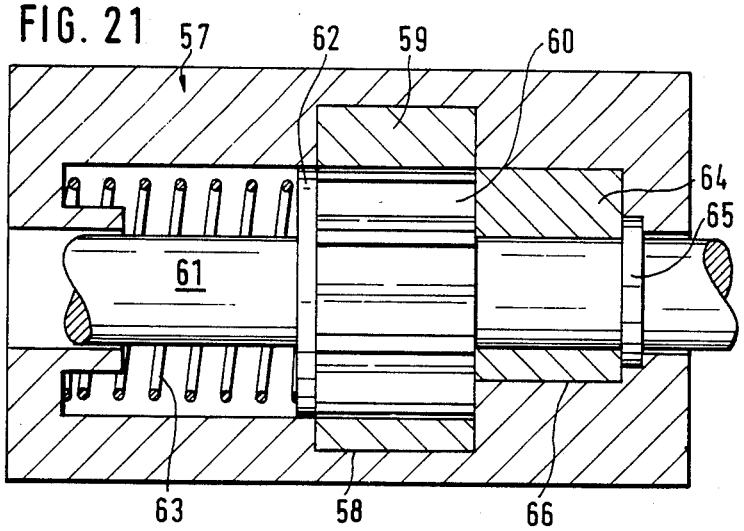
FIG. 21 shows a gear pump according to the present invention in the form of an Eaton pump with a displaceable interior gear in the state of maximum delivery.
Figure 22:
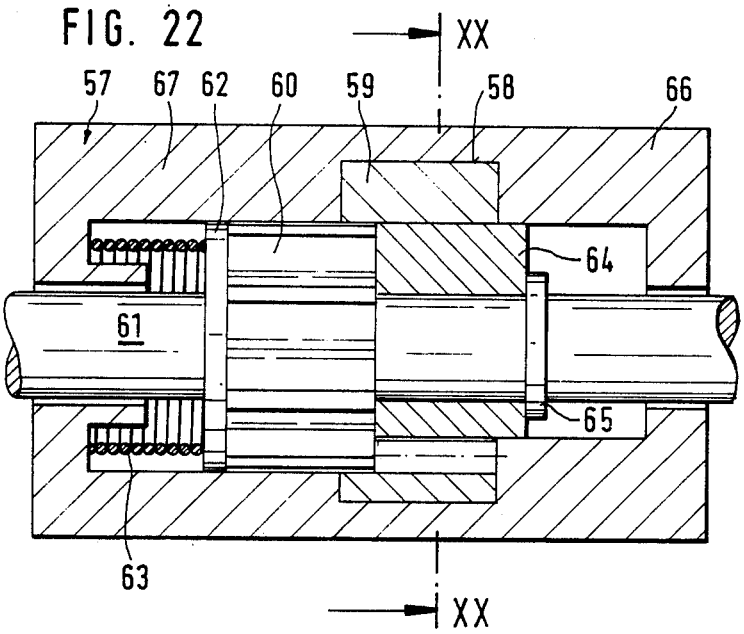
FIG. 22 shows the pump according to FIG. 21 in the state of minimum delivery.

FIGS. 20 to 22 show a kinematically reversed design of the afore-described embodiment of an Eaton pump in that in this case, the hollow gear is axially stationary and the pump gear seated on the drive shaft is axially displaceable. The cylindrical pump casing 57 has a centric recess 58 for receiving a hollow Eaton gear 59 with interior toothing, said toothing mating with a pump gear 60 which is rigidly supported on a displaceable drive shaft 61 that is eccentrically supported in pump casing 57. The one face side of pump gear 60 rests against a collar 62, which is connected with drive shaft 61 and engaged by a reset or control spring 63 that is arranged in pump casing 57. In the state of maximum delivery, pump gear 60 is in mating engagement with hollow gear 59 across its total length. On the other face side of pump gear 60, a sliding part 64 is supported on drive shaft 61 by being axially rigidly connected with drive shaft 61 by a collar 65, which collar is connected with drive shaft 61. When pressure is applied to the free face side of sliding part 64, drive shaft 61 is displaced to the left (FIG. 22), and with it sliding part 64 and pump gear 60 relative to hollow gear 59, so that delivery is reduced.

FIG. 20 shows that sliding part 64 has the shape of a circular cylinder which is eccentrically seated on drive shaft 61. The outside diameter of sliding part 64 conforms to the inside diameter of the one outer segment 66 of the casing and of the hollow gear 59, whereas the inside diameter of other outer segment 67 of the casing conforms to the outside diameter of pump gear 60.

While a few embodiments of the present invention have been shown and described, it will be obvious that many changes and modifications may be made thereunto without departing from the spirit and scope of the invention.

What is claimed is:

1. A gear pump having a casing and a first rotating, toothed pump gear and an opposing second pump gear, said first pump gear being supported axially displaceable in the pump casing and engaging an axially displaceable sliding part on at least the one face wall of said first pump gear, said second pump gear being axially stationary in said casing, said sliding part being adapted to overlap the engagement zone occupied by the first pump gear opposite the second pump gear, the part of the surface of said sliding part facing said second pump gear having a contour matching the path of the teeth of said second pump gear, wherein the improvement comprises:

a pocket-like recess in the pump casing disposed between the first and second gears of the pump on the side diametrically opposite the pressure side of the pump across the axially displaceable first pump gear, said recess hydraulically communicating with the pressure side and disposed in a location in the pump casing which is disposed within the zone of engagement of the pump gears even when said first pump gear is axially displaced.

2. The gear pump according to claim 1, wherein pocket-like recesses are provided in said sliding part axially on both sides of said first pump gear diametrically opposite the pressure side of the pump, said pressure side being disposed between said first and second gears of the pump, and said recesses hydraulically communicating with the pressure side of the pump between the pump gears.

3. The gear pump according to claim 1, wherein the sliding part is connected to the axially movable transmitter of a controller.

4. The gear pump according to claim 1, wherein said sliding part and said displaceable first pump gear are guided in said casing having a control spring on the axial side facing said first pump gear, and a pressure chamber on the axial side facing said sliding part, said spring and said chamber being hydraulically connected with the pressure side between the two pump gears.

5. The gear pump according to claim 4, wherein the pre-stress of said control spring is adjustable.

6. A gear pump having a casing and a first rotating, toothed pump gear and an opposing second pump gear, said first pump gear being supported axially displaceable in the pump casing and engaging an axially displaceable sliding part on at least the one face wall of said first pump gear, said second pump gear being axially stationary in said casing, said sliding part being adapted to overlap the engagement zone occupied by the first pump gear opposite the second pump gear, the part of the surface of said sliding part facing said second pump gear having a contour matching the path of the teeth of said second pump gear, wherein the improvement comprises:

pocket-like recesses are provided in said sliding part axially on both sides of said first pump gear diametrically opposite the pressure side of the pump, said pressure side being disposed between said first and second gears of the pump, and said recesses hydraulically communicating with the pressure side of the pump between the pump gears.

* * * * *